United States Patent [19]

Cooley

[11] Patent Number: 4,836,593

[45] Date of Patent: Jun. 6, 1989

[54] PIZZA UTENSIL

[76] Inventor: John Cooley, 208 Haystack Rd., Zephyrhills, Fla. 34249

[21] Appl. No.: 166,320

[22] Filed: Mar. 10, 1988

[51] Int. Cl.[4] ..... B65D 5/36; B65D 85/00

[52] U.S. Cl. ..... 294/1.1; 206/525; 206/551; 229/DIG. 13

[58] Field of Search ..... 294/1.1, 25, 16, 55; 229/DIG. 13; 206/551, 525

[56] References Cited

U.S. PATENT DOCUMENTS

| | | | |
|---|---|---|---|
| D. 223,158 | 10/1974 | Lowe | D30/99 |
| 3,107,936 | 10/1963 | Parsons | 294/55 |
| 3,142,425 | 7/1964 | Cobb | 294/172 |
| 3,335,846 | 8/1967 | Mills | 206/551 |
| 4,138,153 | 2/1979 | Brown | 294/55 |
| 4,511,039 | 4/1985 | Siemek | 229/DIG. 13 |
| 4,603,825 | 8/1986 | Kotliar | 229/DIG. 13 |

*Primary Examiner*—James B. Marbert

[57] ABSTRACT

A stiff cardboard, paper or plastic cutout form folded to make a generally triangular supporting platform for a single slice of pizza, said platform having dependent therefrom a downward projecting keel for use as a handle, the supporting platform having a cutout channel in the broader end to allow the pizza slice to be pushed to the opposite end with a forefinger. The pointed end is truncated with an inwardly curved section to allow a bite to be taken from the pizza end.

2 Claims, 1 Drawing Sheet

PIZZA UTENSIL

FIELD OF INVENTION

This invention pertains to disposable eating utensils, and in particular to plastic or paper utensils made from sheet material. The present invention concerns a device to handle pizza while eating.

PRIOR ART

The use of disposable eating implements has its roots in prehistorical times. Leaves of trees, wooden skewers, chopsticks and slivers of wood have been used for all of recorded history. The modern use of paper and plastic instruments for eating, serving and holding food is a natural outgrowth of this history. The wide use of disposable containers in the "fast food" industry is replete with examples. All types of food and beverage are served in and with disposable containers and eating implements. Pizza, a widely popular adaptation of an Italian bread pie, is a notable exception. This is particularly interesting when one considers that pizza is an unusually difficult food to handle. The commonest form in which pizza is served is the triangular slice taken from a round pie, generally formed when the pie is cut by several diametral slices. This form is difficult to handle mostly because of the soft and limp nature of the point, which tends to droop and allow the loose topping, usually lubricated by cheese and sauce, to slide off.

OBJECT OF THE INVENTION

It is the main object of this invention to provide a device to assist in the eating of pizza, whereby the pizza slice may be supported over most of it's length while being consumed, avoiding the problem of drooping and dropped toppings. It is a further object of the invention to provide a pizza eating utensil as described, having surfaces upon which may be printed advertising, menus and the like. These and sundry other advantages will be made clear in the succeeding portions of the specification.

DRAWINGS

Figure 1:
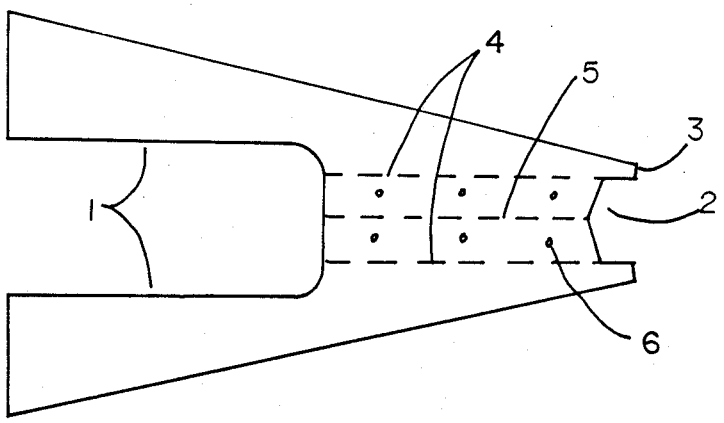
Figure 2:
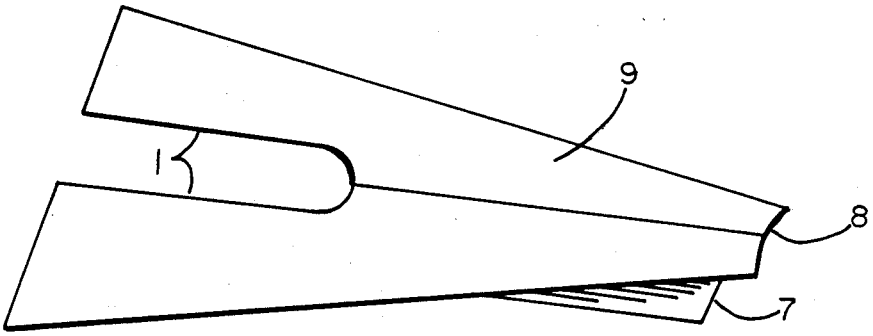
Figure 3:
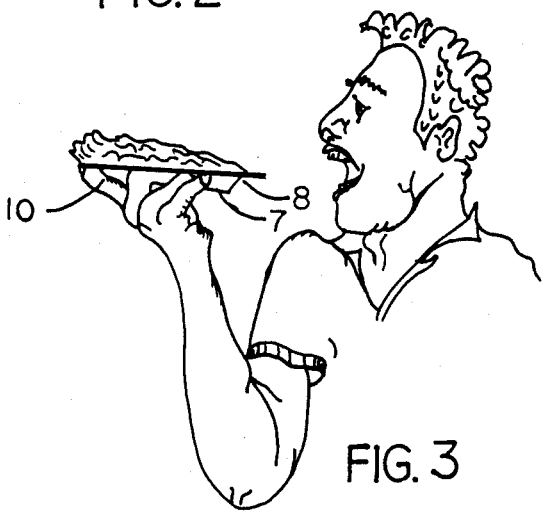

FIG. 1 shows a flat form cutout of a preferred form of the invention, with fold lines and fastening points shown. FIG. 2 shows the flat form of the first figure in the folded (completed) form. FIG. 3 shows the method of using the invention.

DESCRIPTION

Refer now to FIG. 1, where the flat cutout of the preferred form of the invention is shown. The cutout may be made of any of many different types of material, such as light cardboard, waxed stiff paper, or hard or foamed plastic sheet. The only requirement is that it be of a rather stiff character, and be amenable to folding. The form cut from this sheet is generally triangular in shape, the point end being truncated by a "U" shaped cutout, 2, having a pair of "horns", 3, each with a slightly curved and flattend end. The broad end of the triangular piece has a generally rectangular cutout, 1, which is located on the centterline of the triangle. Extending from this cutout, and in line with the "horns", 3, are two fold lines, 4. The centerline, 5, is likewise a fold line. Between the fold lines 4 and 5 glue or other fastening means are applied during assembly.

In assembly, the sheet is folded first at the centerline, 5, then in opposite directions along the fold lines, 4, much as a paper airplane is formed. A fastening means such as glue, staple, paper punch, etc. is applied at this time to the fastening points, 6, to hold the assembly together. The assembly as described results in the object illustrated in FIG. 2. It may be seen that the "horns", 3, have come together to form a somewhat rounded cutout, 8, at the point of the triangular shape, which has been generally preserved. The assembly operation has narrowed the cutout, 1, resulting in a slot which ideally is only somewhat wider than a finger. The folding has formed a rigid, downward projecting keel of a double thickness sheet supporting the upper platform, 9.

OPERATION

To use the invention, a slice of pizza is first placed upon the platform. This can be accomplished by placing the truncated point under the broad end of the pizza slice and pulling the slice up onto the supporting platform by the generally more rigid crust, or the keel may be folded flat to the underside of the platform, and the utensil slid underneath the slice, the keel being subsequently erected, as the slice is lifted from the pan. It will be appreciated by those skilled in the art of eating pizza that the entire slice of pizza, save for the very tip are now supported by the utensil. The keel, 7, is grasped, as can be seen in FIG. 3 between thumb and second, third and fourth fingers. The tip of the pizza, the only portion not supported by the platform, may now be consumed, the curved cutout, 8, serving to clear the bite. The forefinger,10, which is not engaged in holding the keel may now be used to push the slice forward somewhat for the next bite to be taken, the cutout in the wide end providing clearance therefore. In this manner, the slice is consumed until the sides overhang the utensil sufficiently to allow them to be eaten up each side.

It can be appreciated, of course, that various advertising messages, menus, etc can be imprinted on the sheet prior to folding. It may be further pointed out that adding a paper clip to the forward portion of the keel will result in the utensil being converted into a toy glider for the amusement of youngsters. This added feature will result in a wider dissemination of the advertising that may be printed thereon.

Those familiar with the art of disposable utensils will realize that there are any number of minor variations which may be made on the invention herein set forth, and that the preferred example given is not to be considered limiting, but only an example of the concept herein described.

I claim:

1. A pizza utensil comprising a folded sheet of material having a generally triangular shape when folded, said generally triangular shape truncated at the smaller end, said generally triangular shape having a top and a bottom side, said bottom side bearing dependent therefrom a keel formed from a downfolded portion of said folded sheet, said keel of a size to be grasped by a persons fingers, the base of said generally triangular shape having cut therein a slot, said slot axially aligned with said keel, said slot extending from said base toward said truncated smaller end, said slot suitable for the insertion of a finger therein, said slot of such length that a piece of pizza lying on the top side of the utensil may be slid toward the truncated end by action of said finger.

2. A pizza utensil as in claim 1, said folded sheet of material having fastening means applied to the inside fold of said keel whereby said folded sheet may be retained in its folded configuration.

* * * * *